United States Patent [19]

Rankin

[11] 4,297,052

[45] Oct. 27, 1981

[54] BANK EROSION CONTROL UNITS

[76] Inventor: William J. Rankin, 37811 Lake Shore Blvd., Willoughby, Ohio 44094

[21] Appl. No.: 927,658

[22] Filed: Jul. 24, 1978

Related U.S. Application Data

[63] Continuation-in-part of Ser. No. 574,009, May 2, 1975, abandoned, and Ser. No. 755,499, Dec. 29, 1976, abandoned.

[51] Int. Cl.[3] ..... E02B 3/06; E02B 3/14

[52] U.S. Cl. ..... 405/16; 405/31

[58] Field of Search ..... 405/15, 16, 19, 20, 405/21, 25, 30, 31, 33, 34, 35, 284

[56] References Cited

U.S. PATENT DOCUMENTS

| | | | |
|---|---|---|---|
| 919,788 | 4/1909 | Smith | 405/31 |
| 954,283 | 4/1910 | Hawkes | 405/21 |
| 2,652,692 | 9/1953 | Hayden | 405/35 |
| 3,252,287 | 5/1966 | Suzuki | 405/33 X |
| 3,375,667 | 4/1968 | Hard | 405/33 X |
| 3,386,252 | 6/1968 | Nelson | 405/20 |
| 3,846,988 | 11/1974 | Lamy | 405/31 |
| 3,894,397 | 7/1975 | Fair | 405/33 |

FOREIGN PATENT DOCUMENTS

| | | | |
|---|---|---|---|
| 546700 | 4/1956 | Belgium . | |
| 745380 | 11/1966 | Canada . | |
| 1176062 | 8/1964 | Fed. Rep. of Germany | 405/35 |
| 1248567 | 8/1967 | Fed. Rep. of Germany | 405/35 |
| 1056674 | 3/1954 | France | 405/35 |
| 1824 | 2/1917 | Netherlands . | |
| 65257 | 2/1950 | Netherlands . | |
| 424649 | 5/1967 | Switzerland . | |
| 576047 | 5/1976 | Switzerland | 405/35 |
| 877712 | 9/1961 | United Kingdom . | |
| 1149155 | 4/1969 | United Kingdom | 405/34 |

*Primary Examiner*—David H. Corbin

[57] ABSTRACT

Erosion control units comprising a retaining wall means, sand-gravel collecting means and breaker means are installed substantially parallel to the bank to withstand the water's forces. The erosion control units protect the bank-hillside from erosion, aid in forming beaches and build up sand-gravel sideways along adjacent neighboring property.

5 Claims, 10 Drawing Figures

BANK EROSION CONTROL UNITS

CROSS-REFERENCE TO RELATED APPLICATIONS

This application is a continuation-in-part of the copending U.S. application Ser. No. 574,009 filed May 2, 1975, now abandoned—Copending U.S. application Ser. No. 755,499 filed Dec. 29, 1976, now abandoned.

BACKGROUND OF THE INVENTION

The problem of protecting water front property is one which has presented innumberable difficulties. An important factor causing a receding shore line is the erosive action of the water's forces. The erosive action is most damaging during a period when the water level is high and during the spring thaw and spring rainy season.

It has been attempted to check lake erosive action by building retaining walls which parallel the edge of the hillside. There is, however, no wall strong enough to withstand the action of the water's forces for a reasonable time and this type of protection is, therefore, efficacious for a short time only. The problem of inventing bank walls that could withstand the lake water's forces has continued to be a plague without solution. Applicant's invention has answered the problem in the form of Bank Erosion Control Units that not only hold up in protecting the bank from the lake water's forces but can be constructed at a reasonable cost.

SUMMARY OF THE INVENTION

With the foregoing in mind, since the current art of groins, seawalls, breakers and revetments-retaining walls are at best only temporary measures to stop erosion, it is a principal object of the present invention to provide economical erosion control units that hold up. A further object is to provide erosion control units that aid in forming beaches. An additional object is to provide a novel result in building up sand-gravel along adjacent-neighboring property.

Another object is that the installation of the system may be accomplished by the services of one or more able-bodied men. However, fabrication of the units in the construction yard and use of power equipment to install the units are recommended; such as, lowering the units in place by use of a crane.

It should be noted that units withstanding the action of the water's forces while still serviceable can be severely damaged or worn useless by impacts of floating logs and similar objects tossed by the sea against the wall or worn useless by abrasive action of sand and gravel, which require replacement or repair.

The use of linked solid-filled-closed units have their limitations; as for example, waves mixed with sand and gravel remain mixed on striking the closed surface. Also, units having horizontal open ends and linked-interlocked would present similar mixed water, sand and gravel conditions as the closed units, depending on the overall design. In one experiment, the series of linked main units consisted of closed-filled cylindrical upright units, retaining wall, with a series of linked front attached similar units laying flat; i.e., lengthwise, which are part of the wall, including sand-gravel collectors and breakers. Upon action of the water's forces, the units adjusted themselves, settled and locked in the mud and sand-gravel, and tilted lakeward. Thus, the attached front units supported the main units, retaining wall, preventing the main units, retaining wall, from falling over. The combination also acted as a curved front surface which deflected broken oncoming waves of water.

In another experiment, four upright cylindrical units having one open end and drain openings in the bottom were linked together in a box arrangement and filled with sand and gravel—practically all the sand the gravel remained in the units after a severe storm. Accordingly storm sewer pipes and similar units having openings at both ends can be positioned upright (the bottom end locking with the sand-gravel and/or mud) and linked-interlocked in series, and supported in front by preferably attaching the same upright units (or other units) periodically to the main units—the front periodic units also act as wave breakers—furthermore, the open end units act as sand and gravel collectors within its enclosure.

Linked-interlocking one-end-open units with the open end facing toward the bank should be ideal for water property that continues to have bank erosion problems. A series-arrangement of one-end-open units can be combined with attached-linked unit or units which can also act as supporters, sand and gravel collectors, wave breakers and/or protectors. For example, a zigzag boxed in pattern-arrangement of closed-filled cylindrical units attached-linked to the closed end of the series of one-end-open cylindrical units served as supporters, sand and gravel collectors, wave breakers, and protectors from huge passing logs. In another experiment, the open-end units facing the bank did fill in and lock with the bank in two years and served to hold back the previously sliding bank. Note that the open-end units facing the bank-hillside, upon filling in, become closed units.

In view of the foregoing, this invention also comprises the features hereinafter described and particularly pointed out in the claims, the following description and the annexed drawing setting forth in detail certain illustrative embodiments of the invention are not restrictive of the size, shape, pattern-arrangement, or variation of this invention, but are indicative of a few of the various ways in which the principles of the invention may be employed.

DESCRIPTION OF SELECTED EMBODIMENTS

Figure 1:
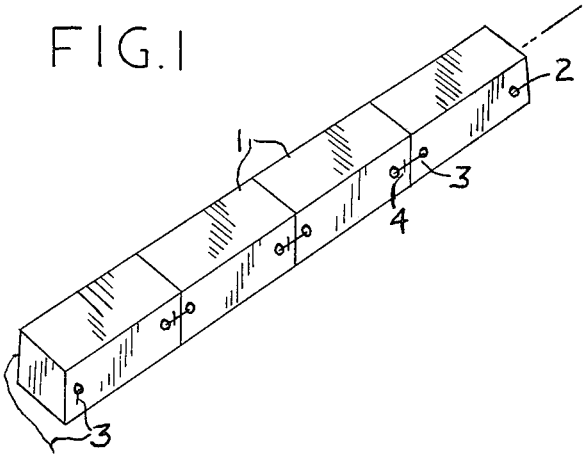
FIG. 1 is an isometric view of a linked-interlocking series-arrangement of closed-filled units.

Referring now to the drawings in detail, FIG. 1 illustrates a series-arrangement of closed-filled units 1. The closed-filled unit 1 has a hole or opening 2 to accommodate a steel cable 3. After lining up the individual units 1, the steel cable 3 is threaded through the openings 2 and locked-linked together with a cable clamp 4. Neither the closed units 1 nor the linkage means are new to the art. However, only three years ago, the U.S. Army Corps of Engineers announced that laying large concrete blocks end to end was an improper bank protection solution in combating the water's forces. Thus, linking bank concrete blocks and other bank closed-filled units is a solution to this heretofore unknown solution bank protection problem. The closed-filled sectional parts 1 linked or unlinked, or similar closed components with adequate drainage opening or openings can be used as a retaining wall or walls in an erosion control system. In a completed erosion control system, the retaining walls 1 can be in sectional parts or continuous reinforced adequately, with reinforcing rods, etc.

Figure 2:
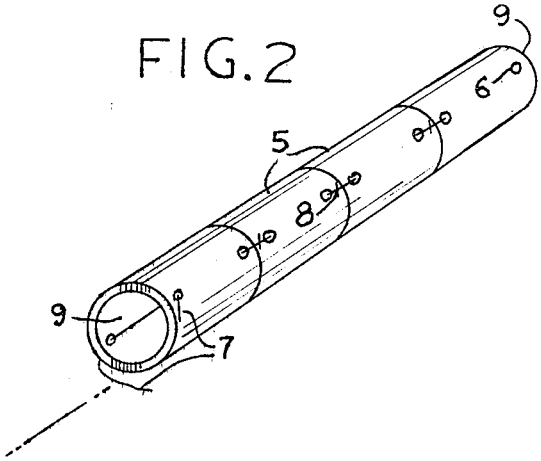
FIG. 2 is an isometric view of a linked-interlocking series-arrangement of open ended units positioned horizontally.
Figure 3:
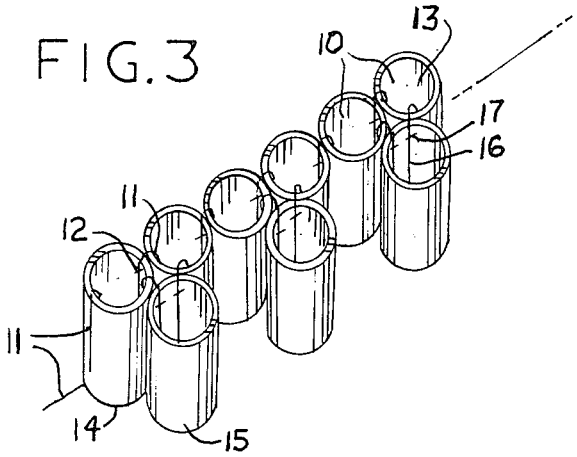
FIG. 3 is an isometric view of a linked-interlocking series-arrangement of open ended units positioned vertically along with supporting interlocking units in front.

Similarly, the use of open ended units also presented an unsolved bank erosion control problem which is solved as shown in FIG. 2. A series of linked-interlocking (steel cable 7 threaded through holes 6 and clamped 8) open ends 9 units 5, end to end, prevent the individual units 5 from being moved about, which heretofore rendered the end to end improvised sewer pipe bulkhead ineffective in adequately protecting the bank from heavy wave action. It was observed that after heavy wave action that an unlinked sewer pipe bulkhead was in disarray. Furthermore, some of the units had been uprighted as the unit 10 seen in FIG. 3. Accordingly, uprighted open end units 10 can be permanently linked-interlocked in series-arrangement alone (depending on arrangement, weight, size, diameter and length) or having attached periodic supporting upright open ended units 15 in front which also serve as wave breakers. The open ended units 10 are linked-interlocked in series with a steel cable 11 using a cable clamp 12. The supporting unit 15 is attached-linked to the main units 10 by a steel cable 16 using a cable clamp 17. In service, the open end 14 becomes locked with the sand-gravel-mud. As the waves mixed with sand and gravel crash against and/or overflow the units 10 and 15 and enter the open end 13, as well as in the openings of unit 15, the sand and gravel settles from the water, allowing the units to fill up with sand and gravel. The open ended sectional parts 5, FIG. 2, and 10, FIG. 3, linked or unlinked, or similar open ended components with adequate drainage facilities can also be used as retaining walls in an erosion control system-combination.

Figure 4:
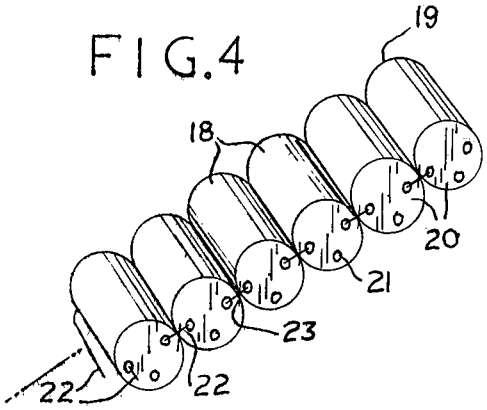
FIG. 4 is an isometric view of linked-interlocking series-arrangement of units having their open end facing toward the bank.

The linked-interlocked in series one-end-open units 18 seen in FIG. 4 is additionally unique in that the open end 19 can lock with the bank and thus, greatly reduce bank erosion caused by heavy wave action and bank water seepage and flow. The units 18 are shown in FIG. 4 as cylindrical having an open end 19 and a closed end 20 with drainage openings 21, linked-interlocked in series with steel cable 22 and cable clamp 23. The units 18 seen in FIG. 4 are linked in series but are actually parallel to each other. This pattern-arrangement is not mandatory in the spirit of this invention and the pattern-arrangement, shape and size can vary and the open end of the one-end-open unit can still lock with the bank, controlling bank erosion. The linkage is also not limited to using a steel cable and cable clamp, other linkage means can be used such as wire, exposed rods,-pipe embedded in concrete-cement, nuts and bolts. In fact, the experimental reinforced cylindrical one-end-open units, approximately two feet in diameter and three feet long, were linked together using $\frac{1}{4}''$ wire ($\frac{3}{8}''$ and $\frac{1}{2}''$ exposed reinforcing rods were embedded in concrete in other experimental units).

Figure 5:
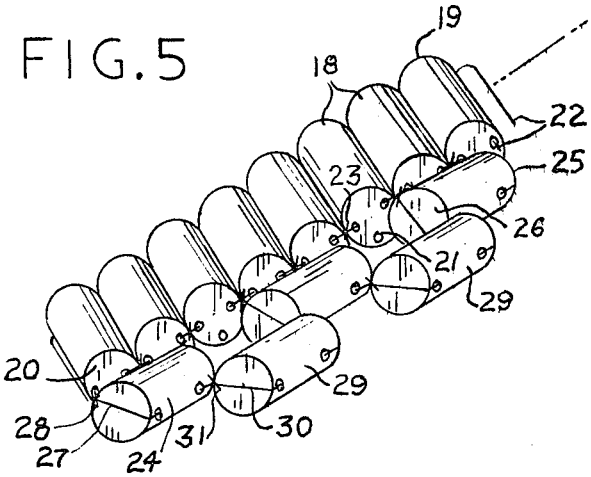
FIG. 5 is an isometric view of FIG. 4 units, which can be used as part of the main wall; along with additional units in front.

In FIG. 5, the units 18 of FIG. 4 were used in the drawing as well as similar units in an actual experiment. In the actual experiment, to the main units 18 of FIG. 4, closed-filled cylindrical supporting units, similar to units 24, approximately two feet in diameter and three feet long, were linked with $\frac{1}{4}''$ wire in a zigzag boxed in pattern-arrangement which also served as sand and gravel collectors, wave breakers and protection from huge logs. For the drawing FIG. 5, to be consistent with the other figures, the supporting cylindrical closed-filled intermediate wave breaker units 24 are linked to the main units 18 with a steel cable 27 using a cable clamp 28. Additional supporting cylindrical closed ends (25 and 26) seaward projecting wave breaker units 29 are also linked to the supporting cylindrical closed units 24 with a steel cable 30 using a cable clamp 31. As in the FIG. 4 discussion, the supporting units being discussed are not limited to closed-filled cylindrical units pattern but can be any pattern-arrangement, size, shape or variation within the spirit of this invention. Nor is it required that the units be closed, though closed units may be preferable, such as, where protection is desirable from huge passing logs. The one-end-open sectional parts 18 seen in FIGS. 4 and 5, linked or unlinked or similar one-end-open components with adequate drainage facilities were used as retaining walls in an erosion control system. The system also included the sand-gravel collectors components 24 and 29. Also, the system included the wave breakers components designated as 29. In action by the wave forces, the system tilted lakeward. In time the retaining wall or walls component or components 18 against the bank would lock with the bank as previously noted, integrating components 18 and the bank as a solid wall. The retaining walls units 18 used in another test system were placed on the strand approximately 10′ away from the bank causing water to pass through the system during storm action necessitating filling with sand bags and other fill material to block out—dam out the water. An additional test wall-breaker was placed adjacent to the wall units 18 and approximately 10′ away which helped in preventing bank erosion. The FIG. 5 system not only deposits sand-gravel landward and seaward but also sideward, protecting adjoining-neighboring property from erosion. The wave breaker 29, intermediate unit 24, and wall 18 took up a space of approximately 7′ (seven feet).

Figure 6:
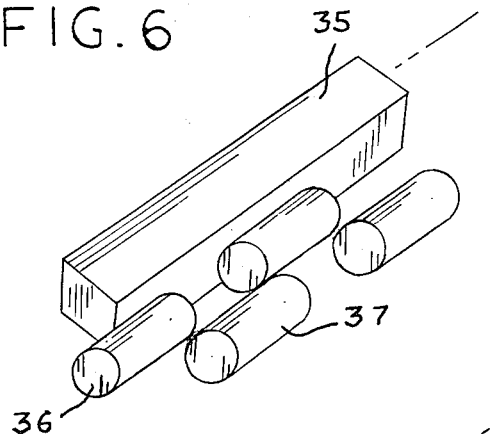
FIG. 6 is an isometric partial view of FIG. 5 units having the back cylindrical wall replaced by a closed wall and offset adjacent units.

The closed wall 35 of FIG. 6 replaces the cylindrical wall components 18 of FIG. 5. Drain openings, water retarders-diverters, and jetties may be employed as needed. The intermediate breaker units 36, seaward projecting breakers units 37, and wall 35 maintain their position relationship by linkage-interlocking, weight, piling-anchoring, one piece construction or other means as the location may so determine. One possible construction is to offset intermediate units 36 with wall 35 as one form of interlocking means.

Figure 7:
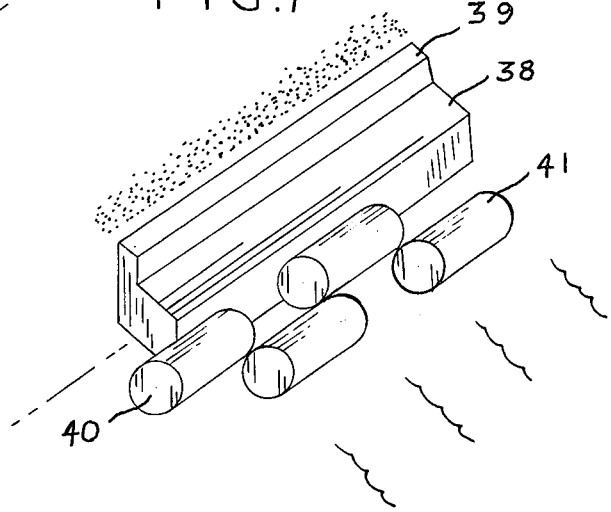
FIG. 7 is an isometric view of FIG. 6 with an extended back wall.

FIG. 7 shows a combination similar to that shown in FIG. 6 having seward projecting breakers 41, intermediate breaker units 40 and back wall 38, but with an extended wall 39. The combination shown in FIG. 7 would be suitable in areas where the water action is severe and an extended wall 39 would be desirable while still maintaining the moderately massive characteristic.

Figure 8:
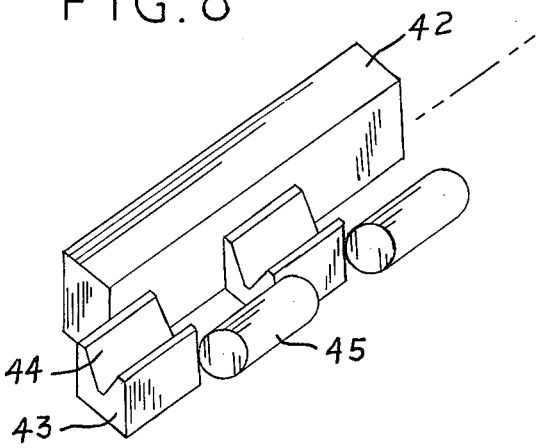
FIG. 8 is an isometric view of FIG. 7 showing an extended wall abutting intermediate open-at-top units which replace the cylindrical-intermediate units.

FIG. 8 shows another variation of the invention having an extended wall 42 intermediate breaker units 43 and seaward projecting breakers 45. The intermediate units are different because they are blocks 43 with an opening 44 at the top instead of closed cylindrical units. It is apparent that as water enters the intermediate area, the water fills open spaces as well as flows through the openings 44 of the blocks 43 allowing the sand-gravel to settle out of the less turbulent waters. Block 43 shows only a single opening at the top but within the spirit of the invention more than one opening can be provided as well as using a step arrangement, steps and openings and other variations as desired.

Figure 9:
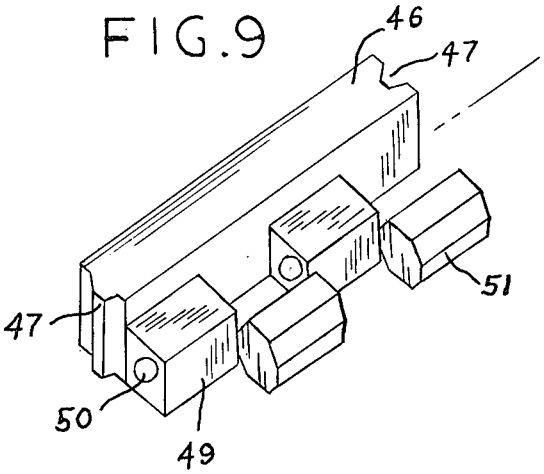
FIG. 9 is an isometric view of an extended wall having interlocking features abutting intermediate block units having holes and adjacent block breakers.

The combination seen in FIG. 9 appears as a block arrangement in conformity to conventional appearance of erosion control units. The extended wall 46, seaward projecting breaker 51, and intermediate breaker units 49 all have the block look. The interlocking means; such as tongue 47 and groove 48 is not confined to this invention—other confinement variations such as interlocking-linkage, piles, weight, cement-concrete wall poured on existing rocks, and other means are within the spirit of this invention. The intermediate units of FIG. 9 show a hole 50 running substantially parallel to the wall which serves a similar function to opening 44 of FIG. 8. The combination shown in FIG. 9 is not confined to a single hole in the intermediate unit 49, but the intermediate units can have more than one hole or opening and is not limited to position, within the spirit of this invention. Breaker block 51 can be small or large with or without internal openings while still maintaining the spirit of this invention.

Figure 10:
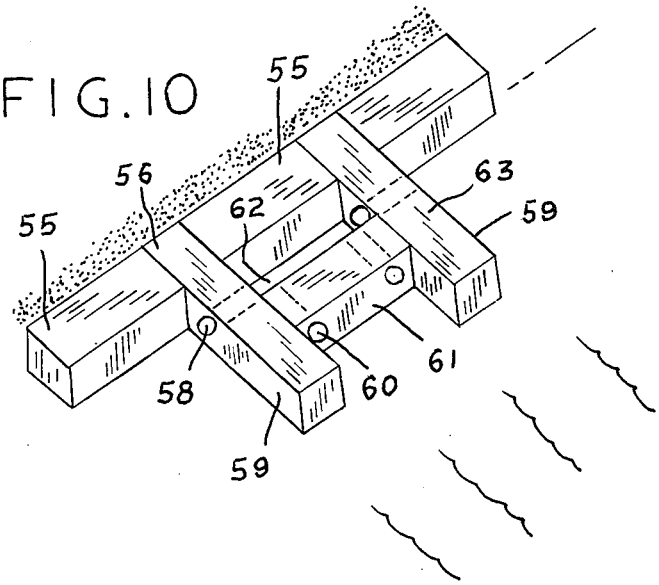
FIG. 10 is an isometric view of a block type arrangement of retaining wall means, breaker means and sand-gravel collecting means.

FIG. 10 structure is equivalent to FIG. 5 structure with backfill. The wall consists of blocks 55 placed lengthwise substantially parallel to the bank and alternating with a portion 56 of the breaker-sand-gravel collecting means 63. Furthermore, the wall 56-breaker-sand-gravel collecting means 63 placed substantially perpendicular to the bank has a forward projecting breaker portion 59 facing seaward and spaced from another breaker 59 by an intermediate breaker unit 61 which is offset from the wall placed generally lengthwise parallel to the wall and abutting the units 63. The intermediate unit 61 has openings 60 generally perpendicular to the bank that allows water-sand-gravel to flow rearward into the sand-gravel collecting area 62. The opening in unit 63 which is generally parallel to the bank allows water-sand-gravel to flow substantially parallel to the bank. In operation, the breaker 59 breaks the force of the wave and spews water into the collecting area 62 rearward and sideward, and the sand-gravel settles out of the water moving sideward, rearward and seaward, and also builds up sand-gravel sideways along adjacent neighboring property. During severe storms, sand-gravel is taken away from the front of the units but the sand-gravel behind the retaining wall remains. As the storms calm down, the sand-gravel is again built up in front of the units and the adjacent neighboring bank.

Note, other equivalent variations are possible within the spirit of this invention. Various equivalent changes can be made in the FIG. 10 structure; such as, the wall can be made of a series of blocks 55, the unit 63 can be sectioned, the unit 61 can be made shorter or the unit or units 63 placed against the wall units 55 can be spread out leaving an opening between units 63 and 61, replacing hole 60, notches or openings at the top of the units in place of openings such as 58 and 60, the holes-openings-notches can be varied and/or deleted, variation of the shape of the structure-units, with or without linkage, etc.

The closed units and variable opening members shown in series and in combination are not limited to those shown in the drawings but can be of any shape, size, variation or pattern-arrangement, within the spirit of this invention. Also, the units shown in the combination can be essentially sectioned and thus made smaller for easier moving or made larger as conditions warrant. This invention is not limited to linkage-interlocking means but includes other position confinement means.

From the foregoing, it is seen that there is no known erosion control combination comprising a retaining wall means, sand-gravel collecting means and breaker means that holds up for a reasonable time. However, applicant's invention not only holds up and protects the bank-hillside from erosion but, also, aids in forming beaches as well as building up sand-gravel along adjacent-neighboring property. Notwithstanding, as previously noted, various combinations in service on beaches give, settle and lock within controlled limits tilting lakeward and can become a part of the bank serving as bank mats-wall. Accordingly, units in the form of mats can be placed on the bank within the spirit of this invention. This invention also includes adapted pilings, sheeting and block arrangements. The use of the term block signifies individual units or continuous unit-units, including walls-retaining walls.

From the above it should be clear that the present invention relates to units for controlling erosion of a bank adajcent a body of water due to waves of the body of water striking the bank. The bank extends upwardly from a strand and the units for controlling erosion of the bank are positioned generally parallel to the shoreline of the body of water. The units comprise a retaining wall for blocking material of the bank from progressing into the body of water. The retaining wall is made up of elements such as 35 in the embodiment of FIG. 6 and the blocks 55 in the embodiment of FIG. 10. The retaining wall is located on the strand and extends generally parallel to the shoreline.

Also each of the embodiments have sand gravel collecting areas adjacent to the retaining wall and on the side thereof facing the body of water. The sand gravel collecting area in each embodiment is defined by wave breakers which extend from the retaining wall and project toward the body of water and from the sand gravel collecting area. The wave breakers in the embodiment of FIG. 6, for example, are the elements 36 and 37. The wave breakers in the embodiment of FIG. 8, for example, are 43 and 45. The wave breakers in the embodiment of FIG. 10, are 59 and 61. Additionally, in each of the embodiments passages are provided for directing water and sand and gravel into the sand gravel collecting areas and from the sand gravel collecting area toward the shoreline of the body of water and laterally of the retaining wall and generally parallel to the shoreline. In the embodiment of FIG. 6, these passages are provided between the wave breakers 36 and 37. In the embodiment of FIG. 8, these passages are designated 44 and also are provided between wave breakers 43 and 45. In the embodiment of FIG. 10, these passages are designated 58 and 60.

I, therefore, particularly point out and distinctly claim as my invention:

1. Units for controlling erosion of a bank adjacent a body of water due to waves of the body of water striking the bank, which bank extends upwardly from a strand and which units are positioned generally parallel to the shoreline of the body of water, said units comprising a retaining wall means located on the strand and extending generally parallel to the shoreline for restricting material of the bank from progressing into the body of water, means defining a sand-gravel collecting area immediately adjacent said retaining wall means and on the side thereof facing the body of water, said means defining said sand-gravel collecting area comprising structure having surfaces which define a chamber open at the top for receiving water and sand and gravel therethrough and passages for directing water and sand and gravel into the sand-gravel collecting area and from the sand-gravel collecting area toward the shoreline and laterally of said retaining wall and generally parallel to the shoreline, said structure including means for breaking the waves before reaching said retaining wall means and said sand-gravel collecting area, said last-recited means comprising a plurality of wave breakers projecting toward said body of water and from said sand-gravel collecting area against which the waves impact, said wave breakers having respective surfaces facing said body of water and against which waves impact, said respective surfaces being spaced different distances from said retaining wall means.

2. Units are defined in claim 1 wherein said retaining wall means comprises a series of abutting wall-defining elements extending generally parallel to the shoreline.

3. Units as defined in claim 2 wherein at least one wave breaker is located between the sand-gravel collecting area and the shoreline.

4. Units as defined in claim 1 wherein said retaining wall means is formed by a series of first blocks and includes at least two wave breakers which are interposed between said first blocks and extend toward the body of water, and said sand-gravel collecting area is located between said wave breakers and is defined in part by a third block interposed between said second blocks, said third block having openings for directing water, sand and gravel toward the sand-gravel collecting area and shoreline.

5. Units as defined in claim 1 wherein said retaining wall means, said structure defining said sand-gravel collecting area and said wave breakers comprise an interconnected unitary construction.

* * * * *